United States Patent [19]

Chilewich et al.

[11] Patent Number: 4,852,272

[45] Date of Patent: Aug. 1, 1989

[54] SLIPPER SOCK CONSTRUCTION AND METHOD FOR MAKING SAME

[75] Inventors: Sandy Chilewich; Kathy Moskal, both of New York, N.Y.

[73] Assignee: Moskal & Chilewich, Inc., New York, N.Y.

[21] Appl. No.: 218,117

[22] Filed: Jul. 12, 1988

[51] Int. Cl.[4] ..... A43B 13/28

[52] U.S. Cl. ..... 36/12; 36/9 R; 36/19 R; 12/142 A; 2/83; 2/239; 2/241

[58] Field of Search ..... 12/142 A; 36/10, 12, 36/14, 18, 19 R, 19 A, 21, 9 R; 2/83, 239, 241

[56] References Cited

U.S. PATENT DOCUMENTS 1,142,265 6/1915 Menge ..... 36/19 R 2,586,045 2/1952 Hoza ..... 36/14

FOREIGN PATENT DOCUMENTS 308135 3/1929 United Kingdom ..... 12/142 A

*Primary Examiner*—Werner H. Schroeder
*Assistant Examiner*—D. Biefeld
*Attorney, Agent, or Firm*—Gottlieb, Rackman & Reisman

[57] ABSTRACT

A method for constructing a slipper sock from a sock and a flexible sole is provided. After adhering the sole to the bottom of the sock, the sock is turned inside out and then a stitch is run along the perimeter of the sock sole in order to create a uniform and aesthetically appealing seam along the raw edge of the sole when the slipper sock is turned right side out.

5 Claims, 3 Drawing Sheets

SLIPPER SOCK CONSTRUCTION AND METHOD FOR MAKING SAME

BACKGROUND OF THE INVENTION

This invention relates to the construction of a slipper sock, and more particularly to a method for constructing a slipper sock which creates a uniform and aesthetically appealing seam along the edge of the sole thereof.

Slipper sock constructions of various forms are well known in the art. Typically, the slipper sock consists of a sock and a sole member which is attached to the sole portion of the sock. In fabricating the slipper sock, the sock is usually fitted over a foot form and the sole member attached to the sock portion by either laminating the sole member to the sock and/or stitching the sole member to the sock.

However, the manufacture of a slipper sock in accordance with the prior art is less than desirable. If the sole member is simply laminated to the sole portion of the sock, the sole member may become disattached from the sock after expanded wear by the user. In order to reinforce the sole/sock attachment, the sole and sock may be stitched together, typically along one of the edges thereof. However, this creates an aesthetically unappealing seam along the edge of the sole/sock juncture.

Accordingly, it is desirable to provide a slipper sock construction which overcomes the above disadvantages, and which includes a uniform and aesthetically appealing seam along the edge of the sole member.

SUMMARY OF THE INVENTION

Generally speaking, in accordance with the invention, a slipper sock construction and a method for making the same is provided. The slipper sock of the invention includes a conventional sock, which during manufacture of the slipper sock is placed or mounted on a "foot form". A suede sole is then adhered to a foam insert, and the foam insert is adhered to the outside sole portion of the sock.

After the suede sock is adhered to the foam insert and the combination then adhered to the sock, the sock is removed from the foot arm and is turned inside out. Then, using a conventional sewing machine, the suede sole and foam insert combination are stitched to the sock along the perimeter of the sock's sole, i.e., along the juncture of the sock's sole and the sock's upper portion.

After the sewing operation is completed, the sock is turned right side out and is ready for wearing.

Accordingly, it is an object of the invention to provide a new and improved method for constructing a slipper sock of novel construction.

Still another object of the invention is to provide a slipper sock construction which includes an aesthetically appealing seam along the raw edge of the sole.

Still a further object of the invention is to provide a slipper sock construction in which the attachment of the sole to the sock is reinforced.

Still other objects and advantages of the invention will in part be obvious and will in part be apparent from following the description.

The invention accordingly comprises the several steps and the relation of one or more such steps with respect to each of the others, and the article possessing the features, properties, and the relation of elements, which are exemplified in the following detailed disclosure, and the scope of the invention will be indicated in the claims.

BRIEF DESCRIPTION OF THE DRAWINGS

For a fuller understanding of the invention, reference is made to the following description taken in connection with the accompanying drawings in which.

DETAILED DESCRIPTION OF THE PREFERRED EMBODIMENTS

Figure 1:
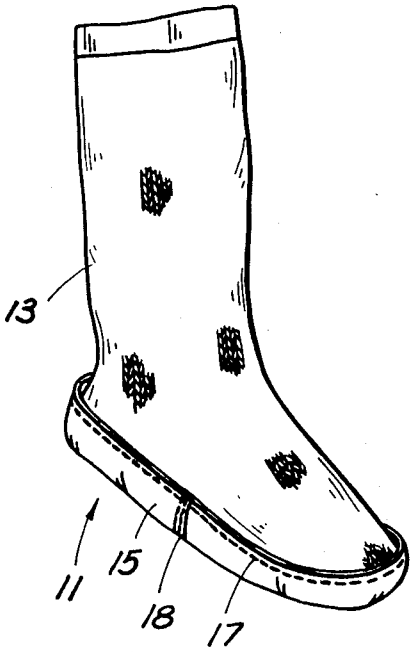
FIG. 1 PRIOR ART
FIG. 1 is a perspective view of a slipper sock made in accordance with the prior art.

Referring first to FIG. 1, a slipper sock construction generally designated at 11 in accordance with the prior art is shown. Slipper sock 11 consists of a sock 13 and a sole 15 attached to the bottom thereof. Sole 15 is attached to sock 13 via stitching running along the perimeter thereof, generally indicated by 17, as well as a stitching 18 running across sole 15. Both stitching 17 and 18 are clearly visible to the observer, thereby detracting from the overall aesthetic appeal of slipper sock 11.

Figure 3:
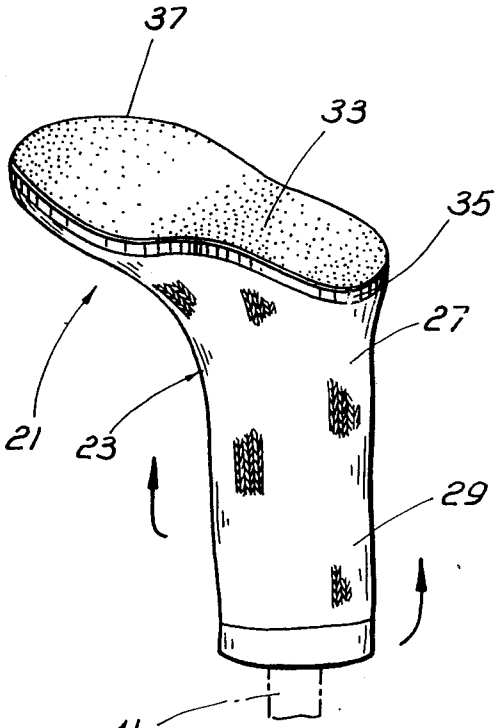
FIG. 3 is a perspective view of the slipper sock constructed in accordance with the invention showing the sole and foam insert combination laminated to the sock.
Figure 2:
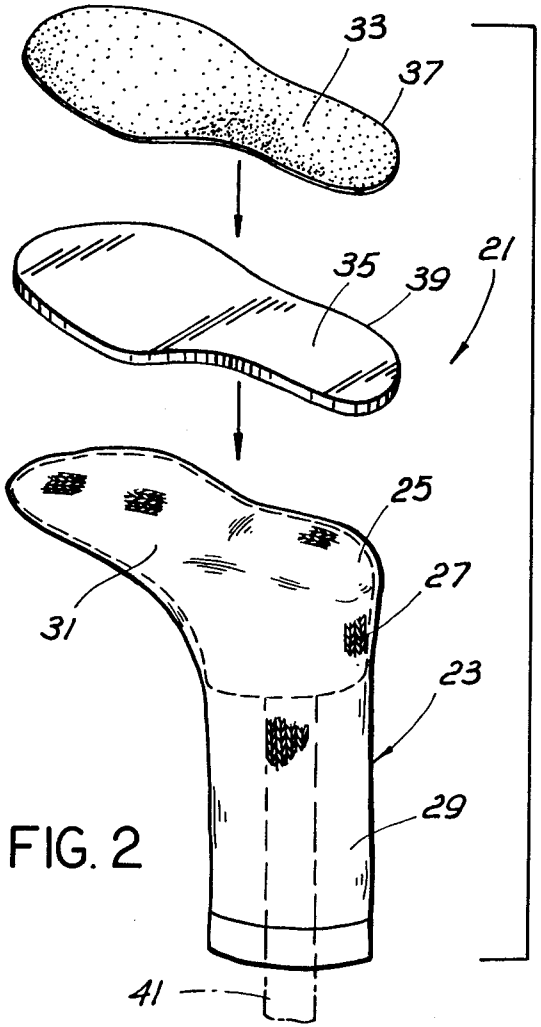
FIG. 2 is an exploded perspective view of the components of a slipper sock constructed in accordance with the invention.

Turning to FIGS. 2 and 3, the components of a slipper sock 21 made in accordance with the invention are now illustrated. Slipper sock 21 includes a conventional knit sock 23, a flexible foam insert 35 and a flexible sole 33. Sock 23 consists of a sole portion 25, upper portion 27 continues with sole portion 25 and a boot portion 29 continues with upper portion 27. Sole portion 25 and upper portion 27 of sock 23 define a juncture or perimeter 31, adjacent to which a continuous stitch is sewn in order to construct the slipper sock of the invention, as described hereinbelow.

Foam insert 35 defines a perimeter 39 and is typically made from foam rubber or like material. Sole 33 also defines a perimeter 37 and may be made from suede, leather or other material resistant to wearing along various floor surfaces. Both foam insert 35 and sole 33 have a shape and dimension similar to the shape and dimension of sole portion 25 of sock 23.

In order to construct a slipper sock 21 as depicted in FIG. 3, sole 33 is first affixed to foam insert 35 along one surface thereof using a conventional adhering or laminating substance, e.g., a commercial glue. Then, the other side of foam insert 35 is adhered to the outside surface of sole portion 25 of sock 23. This portion of the construction of slipper sock 21 is typically completed using a foot form 41, which stiffly supports sock 23 thereon in order that easy attachment of the insert 35/sole 33 combination to sock 23 may be achieved.

Figure 4:
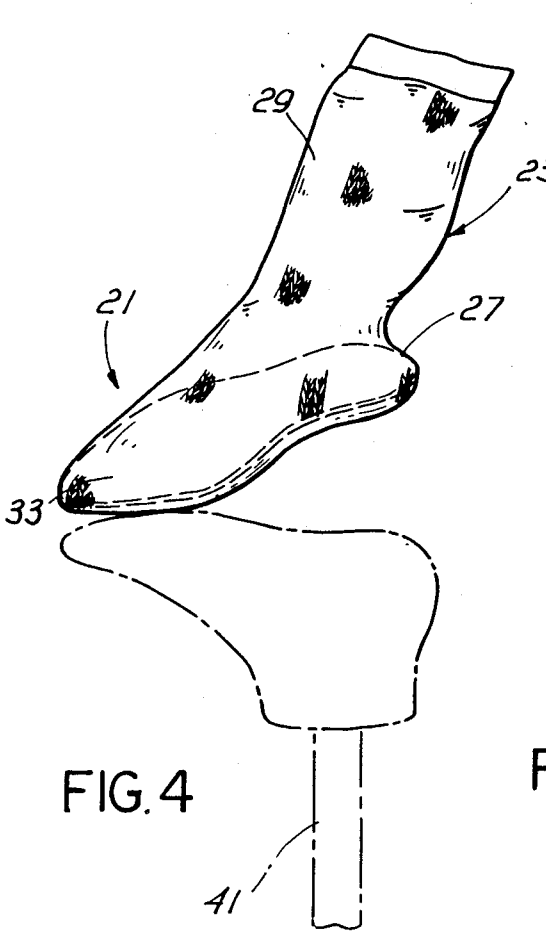
FIG. 4 is a perspective view showing the slipper sock of the invention turned inside out prior to sewing.

After insert 35 and sole 33 are attached (see FIG. 3), slipper sock 21 is removed from foot form 41 and turned inside out as shown in FIG. 4. Once sock 21 is turned inside out, it is now ready for the sewing step of the inventive method.

Figure 5A:
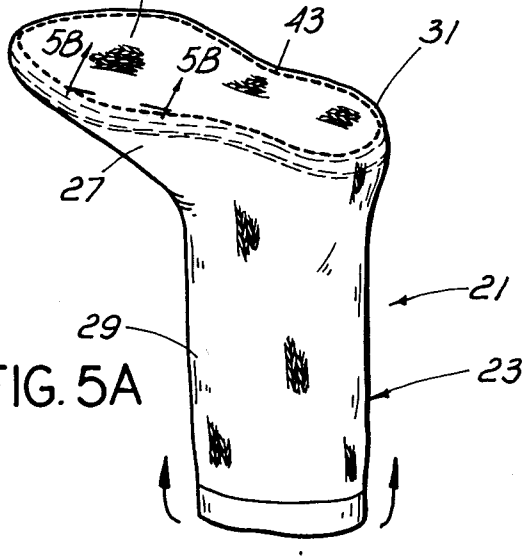
FIG. 5*a* is a perspective view of the slipper sock of the invention in which the suede sole and foam insert are stitched to the sock along the perimeter of the sock sole.
Figure 5B:
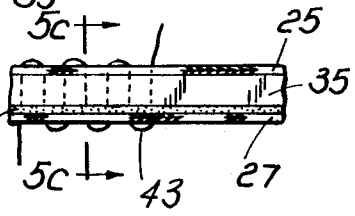
FIG. 5*b* is a cross-sectional view taken along line 5*b*—5*b* of FIG. 5*a;*
Figure 5C:
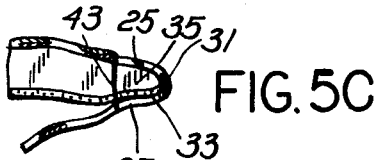
FIG. 5*c* is a cross-sectional view taken along line 5*c*—5*c* of FIG. 5*b;*

In order to ensure that insert 35 and sole 33 remain affixed to sock 23, it is necessary to sew or stitch insert 35 and sole 33 to sock 23, as depicted in FIGS. 5a-5c. Particularly, a continuous stitch 43 is sewn (using, e.g., a sewing machine) through sole portion 25 of sock 23, foam insert 35, sole 33 and upper portion 27, as best shown in FIGS. **5*b* and 5c. Continuous stitch 43 runs adjacent juncture 31 of sock 23, thereby corresponding in shape to sole portion 31, insert 35 and sole 33. Consequently, the various components of slipper sock 21** are suitably stitched together.

Figure 6:
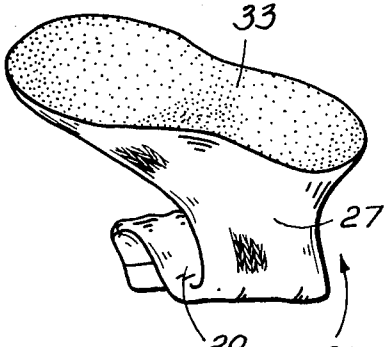
FIG. 6 is a perspective view of the slipper sock of the invention in its final form.
Figure 7:
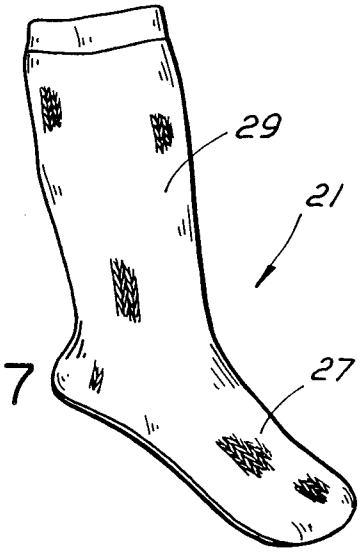
FIG. 7 is a top perspective view of the slipper sock of the invention also in its final form.
Figure 8:
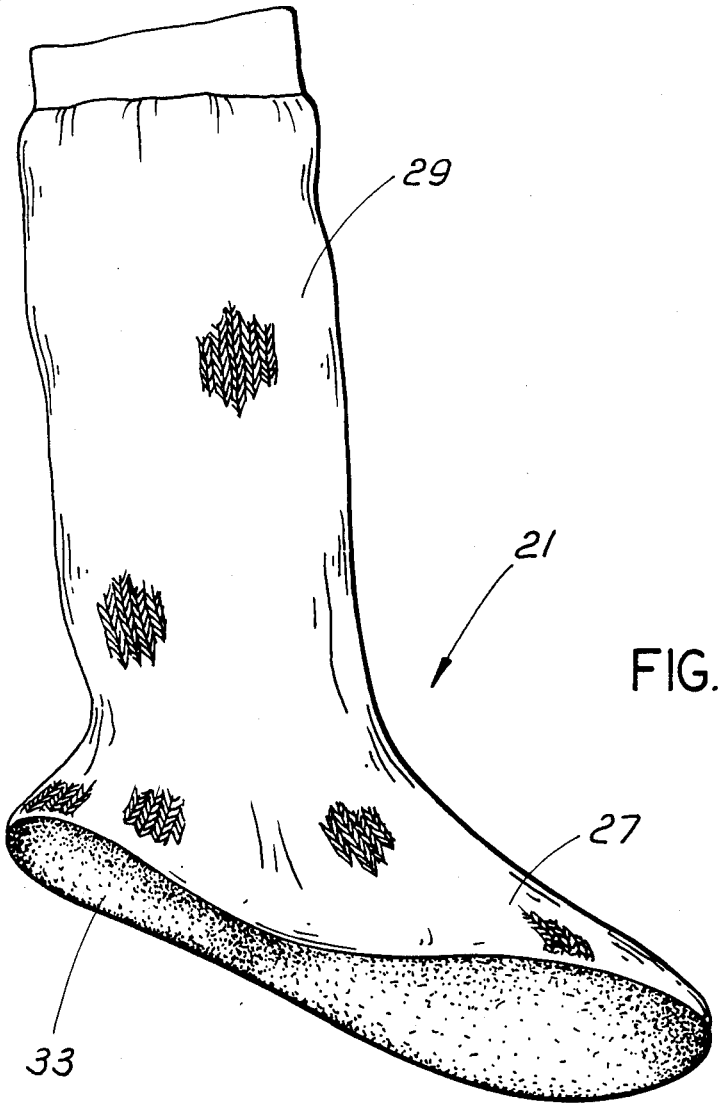
FIG. 8 is a enlarged bottom perspective view of the slipper sock of the invention in its final form.

After the sewing step is completed, slipper sock 21 is turned right side out, as illustrated in FIGS. 6 and 7, and is ready for wearing by the user. As illustrated in FIG. 6, continuous stitch 43 is not visible in the right side out position of slipper sock 21 and therefore a uniform and aesthetically appealing seam along the raw edge of sole 33 of slipper sock 21 is achieved, as best shown at FIG. 8.

Moreover, since sole 33 and insert 35 are attached to sock 23 by both adhering and stitching, the overall construction of slipper sock 21 is reinforced, thereby increasing its wearlife.

It will thus be seen that the objects set forth above, among those made apparent in the preceding description, are efficiently obtained and, since certain changes may be made in carrying out the above method and in article set forth above without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described in all statements of the scope of the invention in which, as a matter of language, might be said to fall therebetween.

We claim:

1. A method for constructing a slipper sock from a sole member having a perimeter and a sock member including an upper portion and a sole portion defining a juncture therebetween, wherein said sole portion of said sock member corresponds substantially in shape and dimension to said sole member, the method comprising:

superimposing said sole member over said sole portion of said sock member;

turning said sock member inside out so that said superimposed sole member is hidden from view; and sewing at least one continuous stitch through said sole portion, said sole member and said upper portion so that said at least one continuous stitch runs adjacent said sole member perimeter and said sock member juncture, whereby said sole member is maintained affixed to said sole portion of said sock member.

2. The method of claim 1, wherein said superimposing step comprises adhering said sole member to said sole portion.

3. The method of claim 2, wherein;

said sole member comprises a sole element and an insert element;

said adhering step comprises adhering said sole element to said insert element and adhering said insert element to said sole portion of said sock member; and said sewing step comprises sewing said continuous stitch through said sole portion, said insert element, said sole element and said upper portion.

4. The method of claim 2, further comprising the step of turning said sock member right side out after said sewing step so that said superimposed sole member is visible.

5. The method of claim 2, wherein said sock member is placed on a foot form during said adhering step.

* * * * *